US009345268B2

(12) United States Patent
Stone et al.

(10) Patent No.: US 9,345,268 B2
(45) Date of Patent: May 24, 2016

(54) METHOD FOR PREPARING SMOKING ARTICLES

(75) Inventors: James Richard Stone, Advance, NC (US); Billy Tyrone Conner, Clemmons, NC (US); Vernon Brent Barnes, Advance, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1034 days.

(21) Appl. No.: 13/448,835

(22) Filed: Apr. 17, 2012

(65) Prior Publication Data

US 2013/0269720 A1 Oct. 17, 2013

(51) Int. Cl.
*A24F 47/00* (2006.01)
*A24C 5/60* (2006.01)

(52) U.S. Cl.
CPC ..... *A24C 5/603* (2013.01); *A24F 47/004* (2013.01); *A24F 47/006* (2013.01)

(58) Field of Classification Search
None
See application file for complete search history.

(56) References Cited

U.S. PATENT DOCUMENTS

| | | | | |
|---|---|---|---|---|
| 3,308,600 | A | 3/1967 | Erdmann et al. | |
| 4,280,187 | A | 7/1981 | Reuland et al. | |
| 4,281,670 | A | 8/1981 | Heitmann et al. | |
| 4,714,082 | A | 12/1987 | Banerjee et al. | |
| 4,850,301 | A | 7/1989 | Greene, Jr. et al. | |
| 4,922,901 | A | 5/1990 | Brooks et al. | |
| 5,027,837 | A * | 7/1991 | Clearman et al. | 131/359 |
| 5,247,947 | A | 9/1993 | Clearman et al. | |
| 5,285,798 | A | 2/1994 | Banerjee et al. | |
| 5,469,871 | A | 11/1995 | Barnes et al. | |
| 5,551,451 | A | 9/1996 | Riggs et al. | |
| 5,560,376 | A | 10/1996 | Meiring et al. | |
| 5,706,834 | A * | 1/1998 | Meiring et al. | 131/369 |
| 5,727,571 | A | 3/1998 | Meiring et al. | |
| 6,229,115 | B1 | 5/2001 | Voss et al. | |
| 7,290,549 | B2 | 11/2007 | Banerjee et al. | |
| 7,296,578 | B2 | 11/2007 | Read, Jr. | |
| 7,434,585 | B2 | 10/2008 | Holmes | |
| 7,503,330 | B2 | 3/2009 | Borschke et al. | |
| 7,726,320 | B2 | 6/2010 | Robinson et al. | |
| 7,836,897 | B2 | 11/2010 | Borschke et al. | |

(Continued)

FOREIGN PATENT DOCUMENTS

| | | |
|---|---|---|
| JP | EP 1 683 431 A1 | 7/2006 |
| WO | WO 2009/112257 | 9/2009 |
| WO | WO 2009/132828 | 11/2009 |

OTHER PUBLICATIONS

PCT International Search Report and Written Opinion for International Application No. PCT/US2013/032822, mailed Jun. 24, 2013.

*Primary Examiner* — Michael J Felton
(74) *Attorney, Agent, or Firm* — Brinks Gilson & Lione

(57) ABSTRACT

A method of modifying the moisture content of fuel elements used in making smoking articles. The method may include overwrapped fuel elements, smoking article components, and/or assembled smoking articles being subjected to drying by flowed ambient air. Unheated air is flowed over the fuel components to adjust and maintain a desired moisture content of the fuel components to a level that permits cutting of the fuel components without chipping or cracking. After the fuel components are cut into individual or two-up fuel elements and combined with smoking article components that may include up to an entire filtered or unfiltered smoking article, they may have more ambient air flowed over them to further reduce the moisture content to a desired level.

10 Claims, 2 Drawing Sheets

(56) References Cited

U.S. PATENT DOCUMENTS

| | | | |
|---|---|---|---|
| 2005/0274390 | A1 | 12/2005 | Banerjee et al. |
| 2006/0169295 | A1 | 8/2006 | Draghetti |
| 2007/0215167 | A1 | 9/2007 | Crooks et al. |
| 2009/0044818 | A1 | 2/2009 | Takeuchi et al. |
| 2011/0041861 | A1 | 2/2011 | Sebastian et al. |
| 2011/0180082 | A1 | 7/2011 | Banerjee et al. |
| 2012/0042885 | A1 | 2/2012 | Stone et al. |
| 2012/0067360 | A1 | 3/2012 | Conner et al. |

* cited by examiner

METHOD FOR PREPARING SMOKING ARTICLES

TECHNICAL FIELD

The present invention relates to products made or derived from tobacco, or that otherwise incorporate tobacco, and are intended for human consumption. Embodiments herein relate to drying apparatus and methods and more particularly to a method of adjusting and controlling the moisture content of fuel elements used in the manufacture of smoking articles, such as cigarettes.

BACKGROUND

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999) and U.S. Pat. No. 7,503,330 to Borschke et al, which is incorporated herein by reference. A cigarette is employed by a smoker by lighting one end thereof and burning the tobacco rod. The smoker then receives mainstream smoke into his/her mouth by drawing on the opposite end (e.g., the filter end) of the cigarette.

Certain smoking articles may be constructed as cigarettes of a type constructed with a physically separate fuel component, aerosol generator or substrate, and mouthpiece component. See, e.g., U.S. Pat. No. 4,714,082 to Banerjee et al., which is incorporated herein by reference. Apparatus and processes for mass producing such improved cigarette smoking articles are disclosed, for example, in U.S. Pat. No. 5,469,871 to Barnes et al.; U.S. Pat. No. 5,560,376 to Barnes et al.; and U.S. Pat. No. 5,727,571 to Meiring et al., each of which is incorporated herein by reference.

Certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). More recently, a cigarette has been marketed in Japan by Japan Tobacco Inc. under the brand name "Steam Hot One." It has also been suggested that the carbonaceous fuel elements of segmented types of cigarettes may incorporate ultrafine particles of metals and metal oxides. See, for example, U.S. Pat. App. Pub. No. 2005/0274390 to Banerjee et al., and 2011/0180082, each to Banerjee et al., each of which are incorporated by reference herein in its entirety.

In the manufacture of such cigarettes, the fuel component may include an extruded carbonaceous fuel element that is circumscribed by a resilient insulating jacket, such as a mat or layer of glass fibers, and is then overwrapped with a cigarette paper or paper-like material and glued, e.g., with a cold adhesive seal, along a longitudinal seam, to form a continuous cylindrical fuel rod. The continuous overwrapped fuel rod may then be cut into shorter lengths to form fuel components suitable for processing, e.g., a six-up fuel rod having a length of about 72 mm.

Yet other types of smoking articles, such as those types of smoking articles that generate flavored vapors by subjecting tobacco or processed tobaccos to heat produced from chemical or electrical heat sources are described in U.S. Pat. No. 5,285,798 to Banerjee et al.; U.S. Pat. No. 7,290,549 to Banerjee et al.; and U.S. Pat. No. 7,726,320 to Robinson et al., and U.S. Pat. App. Pub. Nos. 2007/0215167 to Crooks et al., 2011/0041861 to Crooks et al., 2012/0067360 to Conner, et al., and 2012/0042885 to Stone et al., all of which are incorporated by reference herein in their entirety. One type of smoking article that has employed electrical energy to produce heat has been commercially marketed by Philip Morris Inc. under the brand name "Accord." Smoking articles that employ sources of heat other than tobacco cut filler to produce tobacco-flavored vapors or tobacco-flavored visible aerosols have not received widespread commercial success. However, it would be highly desirable to provide smoking articles that demonstrate the ability to provide to a smoker many of the benefits and advantages of conventional cigarette smoking, without delivering considerable quantities of incomplete combustion and pyrolysis products.

It has been found that drying of the extrudate fuel rod to a relatively low moisture content to prevent problems that may occur with a high moisture content can itself affect processing of the fuel component. For instance, if the overwrapped six-up fuel component has too low a moisture content, i.e., if it is too dry, the extruded rod may fracture or chip when the six-up fuel component is cut into individual fuel elements for assembly into cigarette smoking articles. Methods using heated forced air have been applied to address this.

It would be desirable to provide a method of and an apparatus for adjusting the moisture content of the carbonaceous fuel element to appropriate levels during assembly of the smoking articles to provide fuel components having a moisture content that is at a desired level and is not too high or too low at a given stage of processing. It would also be desirable to provide a method and apparatus for this moisture content adjustment that uses ambient air rather than requiring the extra resources and equipment needed to generate and vent/dispose of heated air flow.

BRIEF SUMMARY

Presently disclosed embodiments include those directed to a method for modifying or adjusting the moisture content of a fuel component for smoking articles comprising an extruded carbonaceous fuel rod (which may be circumscribed with a resilient jacket, overwrapped with paper or a paper-like material, and sealed along a longitudinal seam to form a continuous fuel rod) which is then cut into individual fuel components. The extruded carbonaceous fuel rod advantageously will have a relatively high moisture content for optimum extrusion characteristics. Typically, the moisture content of the extruded carbonaceous rod may be in the range of about 25% to 40% by weight, often, the beginning moisture content may be about 27% to about 35%. After the extruded fuel rod is jacketed, overwrapped, and sealed (before or after being cut into fuel components of a predetermined length, e.g., a six-up rod having a length of about 72 mm), the overall moisture content of the extruded fuel rod may be, for example, in the range of about 27% to about 35%.

The moisture content of the overwrap paper generally should be relatively low, preferably in the range of about 6% to about 18%, and most preferably at the lower end of that range, e.g., about 8% to 12%. Should moisture content of the overwrap paper exceed about 18%, the overwrapped fuel component may swell circumferentially. Accordingly, the moisture content of the overwrap paper may be maintained relatively low during the entire time it is overwrapped about the high moisture content extruded fuel rod. On the other hand, the moisture content of the extruded fuel rod may be maintained above a certain minimum value to lessen likelihood of damage during cutting, assembly, and transport.

After overwrapping, the fuel components may be accumulated in a mass flow accumulation system, such as a conventional Resy accumulator, which may be modified in keeping with principles of the present disclosure to maintain the moisture content of the overwrap paper in the approximate range of about 6% to about 18% to prevent the paper from swelling, splitting or discoloring. This may be accomplished in the accumulator by drawing unheated ambient air over the six-up fuel components at a rate sufficient to remove enough moisture to maintain the moisture content of the paper below 18%, but not sufficient to reduce the moisture content of the extruded carbonaceous rod below about 20%. As such, the moisture content of the extruded rod may thereby be maintained at a moisture content of about 22% to 30%. Under some conditions or with different fuel component configurations, it may be desirable or necessary to heat the ambient air to maintain the appropriate moisture content.

The overwrapped six-up fuel component may successfully be cut without fracturing or chipping the extruded rod if the moisture content of the rod is above about 18%. A preferred range of moisture content of the extruded rod for cutting the six-up fuel components in the 22% to 30% range. Because the composition of the carbonaceous fuel rod may vary substantially, the range of moisture content of the extruded rod may also vary that is most advantageous or optimum for accumulating and processing the fuel components and for cutting the fuel components into individual fuel elements suitable for attachment to a separate aerosol generator or substrate.

The six-up (e.g., about 72 mm long) fuel components may be directed to a tipping apparatus, such as is known and used in assembling Eclipse cigarettes, where each component is cut into six lengths (e.g., of about 12 mm each) to form six jacketed fuel elements, which may then be combined with other components to form two-up or single cigarettes as known in the art and/or as described herein (directly or by reference).

The assembled pieces (whether they include only a heat generation segment, a heat generation segment with a substrate segment, a heat generation plus substrate plus aerosol—e.g., glycerol and cast sheet, an entire cigarette with or without filter, etc.) may then be further dried. However, in keeping with principles of the present disclosure, only ambient (unheated) air flow is used to effect drying. Flow rate of the ambient air and/or the environmental air pressure may be adjusted to achieve the desired final moisture content of the fuel element/substrate sections and to modulate the moisture content difference between the fuel elements and the substrate and/or other sections.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

Embodiments may better be understood with reference to the following drawings, which are illustrative only and are not limiting.

DETAILED DESCRIPTION

Figure 1:
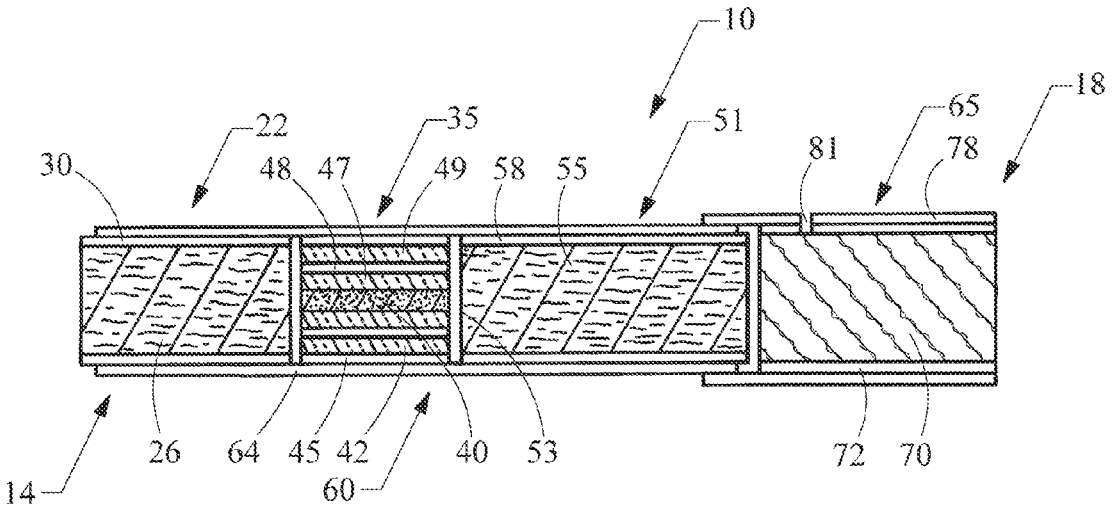
FIGS. 1-2 provide longitudinal cross-sectional views of representative smoking articles.

Embodiments are described with reference to the drawings in which like elements generally are referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments disclosed herein, such as—for example—conventional fabrication and assembly.

Various embodiments will be described more fully hereinafter. The invention is defined by the claims, may be embodied in many different forms, and should not be construed as limited to the embodiments set forth herein; rather, these embodiments are provided so that this disclosure will be thorough and complete, and will fully convey enabling disclosure to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

Certain processes for mixing and extruding a continuous carbonaceous fuel rod, circumscribing the rod with a resilient glass fiber jacket or layer, overwrapping the rod with a paper overwrap and cutting the rod into predetermined lengths for subsequent cutting into fuel elements for individual smoking articles may be understood with reference to U.S. Pat. No. 5,727,571 to Meiring, et al. In some processes, the rod extrudate may have a relatively high moisture content in the range of about 30% to 40% by weight at the time it is circumscribed by the jacket and overwrapped with paper. Drying may be accomplished according to the described process before or during a time when an extruded fuel rod is in an overwrapped fuel component during subsequent processing.

According to U.S. Pat. No. 5,469,871, to Barnes, et al. and to U.S. Pat. No. 5,560,376 to Meiring et al., drying of the fuel element may be accomplished after the extruded fuel rod is overwrapped and cut into predetermined lengths or at other stages of the cigarette manufacturing process. Several possible drying apparatus are disclosed, including passive dryers such as a timed accumulator system, e.g., a Resy accumulator available from Korber & Co., AG, of Hamburg, Germany (hereinafter "Korber") or an S-90 accumulator available from G. D. Societe per Anzioni of Bologna, Italy (hereinafter "GD") or active dryers, such as a hot air blowing system. It is also suggested in that application that the drying stages may be eliminated and relocated since the moisture content of the extruded fuel rod depends on the initial moisture content of the rod and the time lapse between the different stages in the manufacturing process.

Aspects and embodiments of the present disclosure relate to various smoking articles, the arrangement of various components thereof, and methods for preparing those smoking articles, examples of which are illustrated with reference to FIGS. 1 and 2. For the various figures, the thicknesses of the various wrapping materials and overwraps of the various smoking articles and smoking article components may be exaggerated. Most preferably, wrapping materials and overwrap components are tightly wrapped around the smoking articles and smoking article components to provide a tight fit, and provide an aesthetically pleasing appearance. Exemplary smoking article construction may include features such as fibrous filter elements, foamed ceramic monoliths formed as insulators or fuel elements, and other features disclosed in U.S. Pat. App. Pub. Nos. 2011/0041861 to Sebastian et al. and 2012/0067360 to Conner et al., each of which is incorporated herein by reference in its entirety.

Figure 2:
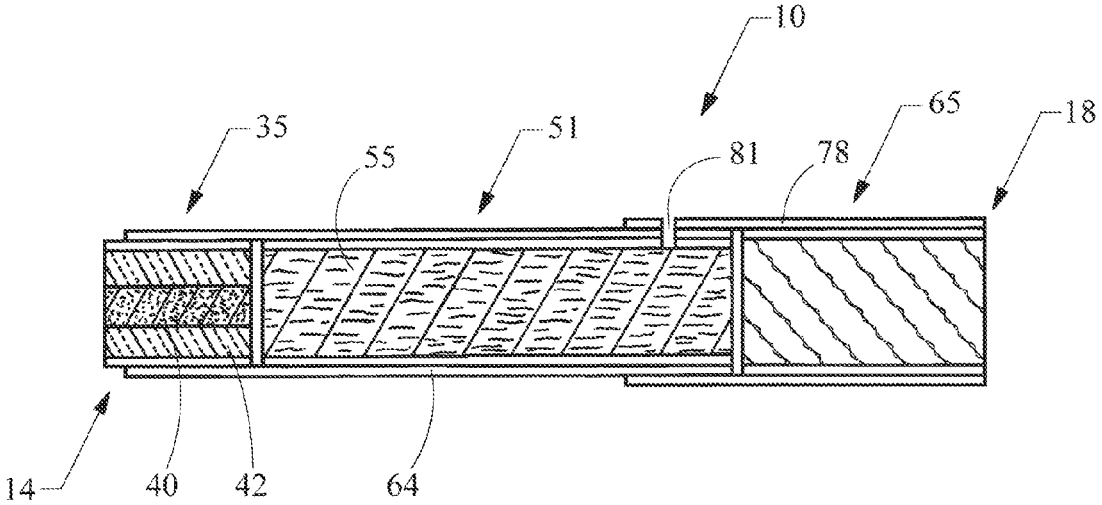

Referring to FIG. 1, a representative smoking article 10 in the form of a cigarette is shown. The smoking article 10 has a rod-like shape, and includes a lighting end 14 and a mouth end 18.

A longitudinally extending, generally cylindrical smokable lighting end segment 22 at the lighting end 14 is positioned, incorporating smokable material 26. A representative smokable material 26 can be a plant-derived material (e.g., tobacco material in cut filler form). An exemplary cylindrical smokable lighting end segment 22 includes a charge or roll of the smokable material 26 (e.g., tobacco cut filler) wrapped or disposed within, and circumscribed by, a paper wrapping material 30. As such, the longitudinally extending outer surface of that cylindrical smokable lighting end segment 22 is provided by the wrapping material 30. Preferably, both ends of the segment 22 are open to expose the smokable material 26. The smokable lighting end segment 22 can be configured so that smokable material 26 and wrapping material 30 each extend along the entire length thereof.

Located downstream from the smokable lighting end segment 22 is a longitudinally extending, generally cylindrical heat generation segment 35. The heat generation segment 35 includes a heat source 40 circumscribed by insulation 42, which may be coaxially encircled by wrapping material 45. The heat source 40 preferably is configured to be activated by combustion of the smokable material 26. Ignition and combustion of the smoking material preferably provide a user with a desirable experience (with respect at least to flavor and time taken to light the smoking article 10). The heat generated as the smokable material is consumed most preferably is sufficient to ignite or otherwise activate the heat source 40.

The heat source 40 may include a combustible fuel element such as—for example—a fuel rod that has a generally cylindrical shape and can incorporate a combustible carbonaceous material. Carbonaceous materials generally have high carbon contents. Preferred carbonaceous materials are composed predominately of carbon, typically have carbon contents of greater than about 60 percent, generally greater than about 70 percent, often greater than about 80 percent, and frequently greater than about 90 percent, on a dry weight basis. Fuel elements can incorporate components other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). A representative fuel element has a length of about 12 mm and an overall outside diameter of about 4.2 mm.

A representative fuel element can be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel element components, formulations and designs set forth in U.S. Pat. No. 5,551,451 to Riggs et al. and U.S. Pat. No. 7,836,897 to Borschke et al., which are incorporated herein by reference in their entirety. Particular embodiments of fuel elements are described below with reference to FIG. 3.

Figure 3:
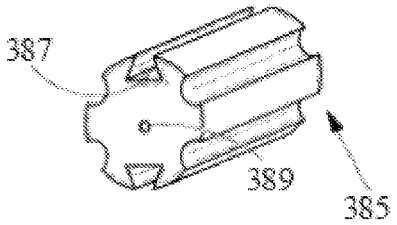
FIG. 3 shows a representative fuel element.

As shown in FIG. 3, a fuel element may include a generally cylindrical body 385 with one or a plurality of longitudinal slots or grooves 387 along its outer surface (e.g., from one to twelve or more grooves) and one or more center bore(s) 389. Some specific constructions may include an 8-slot body with or without a center bore, a 6-slot body with or without a center bore, or a ten-slot body with or without a center bore. Some examples of fuel formulations include, for example: (A) about 35% calcium carbonate, about 45% carbon, about 10% graphite, and about 10% guar gum binder; (B) about 35% calcium carbonate, about 55% carbon, and about 10% guar gum binder; (C) about 40% calcium carbonate, about 45% carbon, and about 15% guar gum binder; and (D) about 45% carbon, about 45% graphite, and about 10% guar gum binder.

In one embodiment, a fuel formulation including about 45% carbon, about 45% graphite, and about 10% guar gum binder may be used. Beginning with about 8% moisture, the components may be mixed, and moistened in an extruder until the moisture content is about 28% to about 31%. The fuel may then be extruded in a desired form, cut, and dried to about 2% to about 8% moisture. After it has been dried, the fuel element may be inserted into an insulator element (that may have been formed, for example, around a mandrel or other forming template). Some moisture may be added if desired to activate the guar gum binder to bind the fuel and insulator. Alternatively or in addition, a pectin film or other film may be provided between the fuel and insulator with appropriate moisture to provide for binding. Those of skill in the art will appreciate that other variants may be used to provide separately extruded fuel and insulator portions that are combined after each is formed, with or without activating a binding agent between them.

Another embodiment of a fuel element 40 may include a foamed carbon monolith formed in a foam process. In another embodiment, the fuel element 40 may be co-extruded with a layer of insulation 42, thereby reducing manufacturing time and expense. Still other embodiments of fuel elements may include those of the types described in U.S. Pat. No. 4,922,901 to Brooks et al. or U.S. Pat. App. Pub. No. 2009/0044818 to Takeuchi et al., each of which is incorporated herein by reference.

A representative layer of insulation 42 can comprise glass filaments or fibers. The insulation 42 can act as a jacket that assists in maintaining the heat source 40 firmly in place within the smoking article 10. The insulation 42 can be provided as a multi-layer component including an inner layer or mat 47 of non-woven glass filaments, an intermediate layer of reconstituted tobacco paper 48, and an outer layer of non-woven glass filaments 49. These may be concentrically oriented or each overwrapping and/or circumscribing the heat source.

In one embodiment, the inner layer 47 of insulation may include a variety of glass or non-glass filaments or fibers that are woven, knit, or both woven and knit (such as, for example, so-called 3-D woven/knit hybrid mats). When woven, an inner layer 47 may be formed as a woven mat or tube. A woven or knitted mat or tube can provide superior control of air flow with regard to evenness across the insulation layer (including as any thermal-related changes may occur to the layer). Those of skill in the art will appreciate that a woven, knit, or hybrid material may provide more regular and consistent air spaces/gaps between the filaments or fibers as compared to a non-woven material which is more likely to have irregularly closed and open spaces that may provide comparatively non-uniform and/or decreased air-flow. Various other insulation embodiments may be molded, extruded, foamed, or otherwise formed. Particular embodiments of insulation structures may include those described in U.S. Pat. App. Pub. No. 2012/0042885 to Stone et al., which is incorporated by reference herein in its entirety.

Preferably, both ends of the heat generation segment 35 are open to expose the heat source 40 and insulation 42 to the adjacent segments. The heat source 40 and the surrounding insulation 42 can be configured so that the length of both materials is co-extensive (i.e., the ends of the insulation 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40. Moreover, smoke produced when the smokable lighting end segment 22 is burned during use of the smoking article 10 can readily pass through the heat generation segment 35 during draw by the smoker on the mouth end 18.

The heat generation segment 35 preferably is positioned adjacent to the downstream end of the smokable lighting end segment 22 such that those segments are axially aligned in an end-to-end relationship, preferably abutting one another, but with no barrier (other than open air-space) therebetween. The close proximity of the heat generation segment 35 and the smokable lighting end segment 22 provides for an appropriate heat exchange relationship (e.g., such that the action of burning smokable material within the smokable lighting end segment 22 acts to ignite the heat source of the heat generation segment 35). The outer cross-sectional shapes and dimensions of the smokable lighting end and heat generation segments 22, 35, when viewed transversely to the longitudinal axis of the smoking article, can be essentially identical to one another (e.g., both appear to have a cylindrical shape, each having essentially identical diameters).

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region (comprising the insulation 42 and relevant outer wrapping materials) makes up about 65 percent to about 90 percent, often about 75 percent to about 85 percent of the total cross-sectional area of that segment 35. For example, for a cylindrical smoking article having a circumference of about 24 mm to about 26 mm, a representative heat source 40 has a generally circular cross-sectional shape with an outer diameter of about 2.5 mm to about 5 mm, often about 3 mm to about 4.5 mm.

A longitudinally extending, cylindrical aerosol-generating segment 51 is located downstream from the heat generation segment 35. The aerosol-generating segment 51 includes a substrate material 55 that, in turn, acts as a carrier for an aerosol-forming agent or material (not shown). For example, the aerosol-generating segment 51 can include a reconstituted tobacco material that includes processing aids, flavoring agents, and glycerin.

The foregoing components of the aerosol-generating segment 51 can be disposed within, and circumscribed by, a wrapping material 58. The wrapping material 58 can be configured to facilitate the transfer of heat from the lighting end 14 of the smoking article 10 (e.g., from the heat generation segment 35) to components of the aerosol-generating segment 51. That is, the aerosol-generating segment 51 and the heat generation segment 35 can be configured in a heat exchange relationship with one another. The heat exchange relationship is such that sufficient heat from the heat source 40 is supplied to the aerosol-formation region to volatilize aerosol-forming material for aerosol formation. In some embodiments, the heat exchange relationship is achieved by positioning those segments in close proximity to one another. A heat exchange relationship also can be achieved by extending a heat conductive material from the vicinity of the heat source 40 into or around the region occupied by the aerosol-generating segment 51. Particular embodiments of substrates may include those described below or those described in U.S. Pat. App. Pub. No. 2012/0042885 to Stone et al., which is incorporated by reference herein in its entirety.

A representative wrapping material 58 for the substrate material 55 may include heat conductive properties to conduct heat from the heat generation segment 35 to the aerosol-generating segment 51, in order to provide for the volatilization of the aerosol forming components contained therein. The substrate material 55 may be about 10 mm to about 22 mm in length, with certain embodiments being about 11 mm to about 12 mm in length, and other embodiments ranging up to about 21 mm.

The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. Certain cast sheet constructions may include about 270 to about 300 mg of tobacco per 10 mm of linear length. That tobacco, in turn, can be treated with, or processed to incorporate, aerosol-forming material and/or at least one flavoring agent, as well as a burn retardant (e.g., diammonium phosphate or another salt) configured to help prevent ignition and/or scorching by the heat-generation segment. A metal inner surface of the wrapping material 58 of the aerosol-generating segment 51 can act as a carrier for aerosol-forming material and/or at least one flavoring agent.

In other embodiments, the substrate 55 may include a tobacco paper or non-tobacco gathered paper formed as a plug section. The plug section may be loaded with aerosol-forming materials, flavorants, tobacco extracts, or the like in a variety of forms (e.g., microencapsulated, liquid, powdered). A burn retardant (e.g., diammonium phosphate or another salt) may be applied to at least a distal/lighting-end portion of the substrate to help prevent ignition and/or scorching by the heat-generation segment.

In these and/or other embodiments, the substrate 55 may include pellets or beads formed from marumarized and/or non-marumarized tobacco. Marumarized tobacco is known, for example, from U.S. Pat. No. 5,105,831 to Banerjee, et al., which is incorporated herein by reference. Marumarized tobacco may include about 20 to about 50 percent (by weight) tobacco blend in powder form, with glycerol (at about 20 to about 30 percent by weight), calcium carbonate (generally at about 10 to about 60 percent by weight, often at about 40 to about 60 percent by weight), along with binder and flavoring agents. The binder may include, for example, a carboxymethyl cellulose (CMC), gums (e.g., guar gum), xanthan, pullulan, or alginates. The beads, pellets, or other marumarized forms may be constructed in dimensions appropriate to fitting within a substrate section and providing for optimal air flow and production of desirable aerosol. A container, such as a cavity or capsule, may be formed for retaining the substrate in place within the smoking article. Such a container may be beneficial to contain, for example, pellets or beads of marumarized and/or non-marumarized tobacco. The container may be formed using wrapping materials as further described below. The term "tobacco pellets" is defined herein to include beads, pellets, or other discrete small units of tobacco that may include marumarized and/or non-marumarized tobacco. The tobacco pellets may have smooth, regular outer shapes (e.g., spheres, cylinders, ovoids, etc.) and/or they may have irregular outer shapes. In one example, the diameter of each tobacco pellet may range from less than about 1 mm to about 2 mm. The tobacco pellets may at least partially fill a substrate cavity of a smoking article as described herein. In one example, the volume of the substrate cavity may range from about 500 $mm^3$ to about 700 $mm^3$ (e.g., a substrate cavity of a smoking article where the cavity diameter is about 7.5 to about 7.8 mm, and the cavity length is about 11 to about 15 mm, with the cavity having a generally cylindrical geometry). In one example, the mass of the tobacco pellets within the substrate cavity may range from about 200 mg to about 500 mg.

Figure 4:
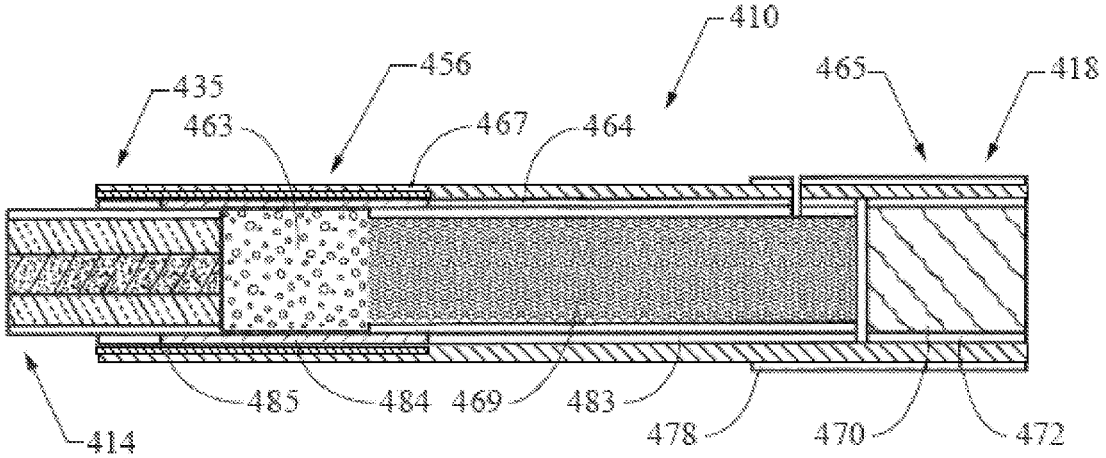
FIG. 4 shows a longitudinal cross-sectional view of a representative smoking article including a tobacco pellet substrate.

In another embodiment, a smoking article may be constructed with a substrate 463 including tobacco pellets, described here with reference to FIG. 4, which is a longitudinal section view of a cigarette 410 having a lighting end 414 and a mouth end 418. The substrate 463 (which may also be used in other embodiments) may be formed by any appropriate method, such as a marumarization method. The cigarette body includes a tobacco rod 469 disposed between the substrate 463 and the filter 470. The tobacco rod 469 may be embodied as tobacco cut filler, cast sheet tobacco paper, and/or other tobacco product(s) in a rod form. The filter 470 is shown as constructed with overlying layers of plug wrap 472 and tipping paper 478. The heat-generation segment 435 and other components may be constructed as described herein and elsewhere in this and other embodiments configured to be practiced within the scope of the present invention.

The substrate 463 may be contained within a substrate cavity 456. The substrate cavity 456 may be formed by the heat-generation segment 435 at one end, the tobacco rod 469 at the opposite end, and a wrapping material 464 around the circumference of at least the substrate (and—in some embodiments—extending along an entire length from the filter to the lighting end). A cylindrical container structure (e.g., a heavy paper tube) 467 may circumferentially encompass the substrate cavity 456 within the wrapping material 464 and between the heat-generation segment 435 at one end and the tobacco rod 469 at the opposite end. The heat-generation segment 435 and the tobacco rod 469 may be joined to one another by the wrapping material 464. To that end, the wrapping material 464 may circumscribe at least a downstream portion of the heat-generation segment 435 and at least an upstream portion of the tobacco rod 469. The heat-generation segment 435 and the tobacco rod 469 may be spaced longitudinally from one another. In other words, the heat-generation segment 435 and the tobacco rod 469 may not be in abutting contact with one another. The substrate cavity 456 may be defined by a space extending longitudinally within the wrapping material 464 between the downstream end of the heat-generation segment 435 and the upstream end of the tobacco rod 469 as shown in FIG. 4. The substrate 463 may be positioned within the substrate cavity 456. For example, the substrate cavity 456 may be at least partially filled with tobacco pellets. The substrate cavity 456 may contain the substrate 463 to prevent migration of the tobacco pellets.

The wrapping material 464 may be configured, for example, as a heat-conducting material (e.g., foil paper), insulating material, heavy-gauge paper, plug wrap, cigarette paper, tobacco paper, or any combination thereof. Additionally, or alternatively, the wrapping material 464 may include foil, ceramic, ceramic paper, carbon felt, glass mat, or any combination thereof. Other wrapping materials known or developed in the art may be used alone or in combination with one or more of these wrapping materials. In one embodiment, the wrapping material 464 may include a paper material having strips or patches of foil laminated thereto. The wrapping material 464 may include a paper sheet 483. The paper sheet 483 may be sized and shaped to circumscribe the heat-generation segment 435, the substrate cavity 456, and the tobacco rod 469 as described above. To that end, the paper sheet 483 may be substantially rectangular in shape with a length extending along the longitudinal direction of the smoking article and a width extending in a direction transverse to the longitudinal direction.

The width of the paper sheet 483 may be slightly larger than the circumference of the smoking article 410 so that the paper sheet may be formed into a tube or a column defining an outer surface of the smoking article. For example, the width of the paper sheet 483 may be from about 18 to about 29 mm. The length of the paper sheet 483 may be sufficient to extend longitudinally along an entire length of the substrate cavity 464 and to overlap the heat-generation segment 435 and the tobacco rod 469. For example, the length of the paper sheet 483 may be about 50 to about 66 mm. The paper sheet 483 may have a length sufficient to overlap substantially an entire length of the tobacco rod 469 as shown in FIG. 4. In one example, the paper sheet (or other wrapping material) may have a thickness of about 1 mil to about 6 mil (about 0.025 mm to about 0.15 mm).

A foil strip or patch 484 may be laminated to or otherwise incorporated with the paper sheet 483 to form a laminated coated region. The foil strip 484 may have a width extending along substantially the entire width of the paper sheet 483 to circumscribe substantially the entire circumference of the heat-generation segment 435, the substrate cavity 464, and the tobacco rod 469 as further described below. The foil strip 484 also may have a length extending along a portion of the length of the paper sheet 483. Preferably, the foil strip 484 may extend along a sufficient portion of the length of the paper sheet 483 such that the foil strip extends along the entire length of the substrate cavity 456 and overlaps at least a portion of the heat-generation segment 435 and the tobacco rod 469. For example, the length of the foil strip 484 may be from about 16 to about 20 mm. In one example, the foil strip may have a thickness of about 0.0005 mm to about 0.05 mm. An overlying layer 485 may be included, which may be embodied as, for example, a paper tube encompassing the outer surface of the foil region 484 of the paper sheet 483 between it that the paper tube 467.

The foil strip 484 may be formed from any heat conducting material including, for example, tin, aluminum, copper, gold, brass, other thermoconductive materials, and/or any combination thereof. In this manner, the substrate cavity 456 may be defined by a foil-lined paper tube or column formed by the wrapping material 464. The wrapping material may include a registered facing of the foil strip at a discrete location on the wrapping material.

The smoking article may include a heat-generation segment, a substrate segment (e.g., a monolithic substrate or a substrate cavity including pellets or beads of substrate material), and a tobacco rod. It may be desirable to provide an intermediate segment from so-called "two-up" rods that may be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; U.S. Pat. No. 6,229,115 to Vos et al.; U.S. Pat. No. 7,434,585 to Holmes; and U.S. Pat. No. 7,296,578 to Read, Jr.; and U.S. Pat. Appl. Pub. No. 2006/0169295 to Draghetti, each of which is incorporated by reference herein. Methods and structures associated with two-up rods for embodiments such as the one described above with reference to FIG. 4 are described in U.S. Pat. Pub. No. 2012/0067360 to Conner et al., which is incorporated herein by reference in its entirety.

Methods of making a smoking article may vary, but—within the scope of the present disclosure—preferably will include steps for modifying the moisture of the fuel element without using heated forced air. The presently disclosed method does not use any heated forced air, but instead relies upon use of ambient air that has not been heated. The method is described here with reference to a single fuel rod, but those of skill in the art will appreciate that the method described is appropriate for, and will readily be understood with regard to, high throughput production of smoking articles. The equipment to be used for implementing the method will readily be understood with reference to, for example, U.S. Pat. No. 5,560,376 to Meiring, which is incorporated by reference herein in its entirety. However, in contrast with Meiring, equipment for use with the present method will not require the heating elements, because the present method relies upon flowing ambient air that has not been subjected to a heater. Ambient air temperature is subject to environmental conditions, but is generally defined for the methods herein as being about 16° C. to about 35° C., preferably about 23° C. to about 29° C.

In one embodiment of a method, a plurality of six-up fuel elements (or other singly- or multiply-staged fuel elements) including a formulation as described herein or otherwise known in the art are provided. In the present example of a method, the fuel elements may have a starting moisture content, by weight, of about 27% to about 35%, and may often have a starting moisture content of about 29% plus or minus about 1.5%. The fuel element may be overwrapped with an insulation material as described above and have ambient air flowed over them to reduce the moisture content from the starting moisture content. The six-up fuel elements may then be cut into smaller units such as, for example, three two-up elements, although the six-up or other multiple-length fuel rod elements may be cut into smaller units (e.g., two-up, three-up, single) and overwrapped later. In certain embodiments, the overwrap will not be adhered or otherwise bound to the fuel element, or any bonding may not take place until individual (e.g., single/one-up) fuel elements are separate from each other and overwrapped. Next, the two up elements may be assembled into a smoking article component, such as an outer front piece component that includes overlying wrapping material as described above with reference to any of FIGS. 1-4. In some embodiments, the two-up elements may be assembled into smoking article components embodied as two-up smoking articles, constructed with the components described above with reference to FIGS. 1-4, and which may be understood with reference to, for example, U.S. Pat. App. Publ. No. 2012/0067630 to Conner et al. (filed Sep. 20, 2011), which is incorporated herein by reference in its entirety and which includes pelleted tobacco material substrate that may be vertically assembled. Vertical and other assembly methods may be understood with reference to PCT Publ. Nos. WO2009/012257 to Tallier and WO2009/0132828 to Grenaud, each of which is incorporated herein by reference with respect only to methods and materials disclosed for assembling and filling a cavity in a smoking article component.

Then, the assemblies (i.e., the two-up outer front pieces, the two-up smoking articles, or individual smoking articles) may be directed through an ambient air flow. This may be done, for example, by moving them (e.g., by conveyor) through a region provided with ambient air flow. For a two-up smoking article, this process will generally allow drying of the fuel element and equilibration of its moisture content with moisture content of the substrate (e.g., pellets including tobacco material). The ambient air flow may be bi-directional, that is, the air may be flowed from one end of the assembly to the other, and then in the opposite direction. This may be facilitated by having the assemblies aligned generally parallel along a conveyor, and may provide for efficient and effective attainment of a desired moisture content level.

Final moisture content of the fuel element preferably will be at a level desirable to provide for efficient handling and not adversely affecting other components of the smoking articles being made. In certain embodiments, a final moisture content of the fuel element may be about 1% to about 10%, preferably about 3% to about 8%. For embodiments including cast sheet material in smoking article construction, the moisture content of the cast sheet material may be about 10% to about 14%. For two-up smoking article units, the method may further include a step of cutting the units into individual smoking articles. In another aspect, embodiments of the present disclosure may include a cigarette made according to any of the methods—including any combination thereof—described herein.

From the foregoing, it will be appreciated by those skilled in the art that certain embodiments disclosed here may provide a particularly effective and advantageous process and apparatus for solving several problems associated with the manufacture of smoking articles incorporating extruded carbonaceous fuel rods.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. Although specific terms are employed herein, they are used in a generic and descriptive sense only and not for purposes of limitation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment.

We claim:

1. A method for modifying moisture content of a fuel element used in making smoking articles, the method comprising steps of:

providing a plurality of fuel elements having a starting moisture content;

next, flowing unheated ambient air over the fuel elements to reduce the moisture content to below the starting moisture content;

next, cutting the fuel elements into smaller units;

next, assembling the fuel elements into smoking article components that include substrate material, which substrate material has a substrate moisture content; and next, flowing unheated (about 16° C. to about 35° C.) ambient air over the fuel elements assembled into the smoking article components and thereby further reducing the moisture content to a predetermined target moisture content, which predetermined target moisture content is also thereby equilibrated with the substrate moisture content wherein the step of flowing unheated ambient air over the fuel elements includes bi-directional air flow, both from a first end toward a second end and from a second end toward a first end.

2. The method of claim 1, where the starting moisture content is about 27% to about 35%.

3. The method of claim 1, where the starting moisture content is about 29% plus or minus about 1.5%.

4. The method of claim 1, where the smaller units into which the fuel elements are cut comprise two-up units.

5. The method of claim 1, where the smoking article component into which the fuel elements are assembled comprises a two-up smoking article.

6. The method of claim 5, where the method further comprises a step of cutting the two-up smoking articles into individual smoking articles.

7. The method of claim 1, where the predetermined target moisture content is about 1% to about 10%.

8. The method of claim 1, where the predetermined target moisture content is about 3% to about 8%.

9. The method of claim 1, where the smoking article component into which the fuel elements are assembled further comprises one or more of an outer wrapping material and a filter.

10. The method of claim 1, where the substrate includes tobacco pellets.

* * * * *